US006209756B1

(12) United States Patent
Van Der Heijden

(10) Patent No.: US 6,209,756 B1
(45) Date of Patent: Apr. 3, 2001

(54) CONTAINER AND COMBINATION PACKAGE COMPRISING SUCH CONTAINER AND A COVER

(75) Inventor: Lambertus Gerardus Van Der Heijden, Maarssen (NL)

(73) Assignee: Diversey Lever, Inc., Plymouth, MI (US)

( * ) Notice: Subject to any disclaimer, the term of this patent is extended or adjusted under 35 U.S.C. 154(b) by 0 days.

(21) Appl. No.: 09/387,457

(22) Filed: Sep. 1, 1999

(30) Foreign Application Priority Data

Sep. 4, 1998 (EP) ..... 98202969

(51) Int. Cl.[7] ..... B65D 35/56; B65D 35/14; B65D 35/38; B67D 1/16

(52) U.S. Cl. ..... 222/105; 222/108; 222/107; 222/571; 383/904

(58) Field of Search ..... 222/105, 107, 222/183, 108, 571; 383/904, 906

(56) References Cited

U.S. PATENT DOCUMENTS

| | | | | |
|---|---|---|---|---|
| 2,950,029 | * | 8/1960 | Winstead | 383/906 |
| 3,112,047 | * | 11/1963 | Weinreich et al. | 222/105 |
| 3,199,742 | | 8/1965 | Hill . | |
| 4,946,072 | * | 8/1990 | Albert et al. | 222/105 |

FOREIGN PATENT DOCUMENTS

| | | |
|---|---|---|
| 35 29 659 | 2/1987 | (DE) . |
| 778 223 | 6/1997 | (EP) . |
| 1 232 539 | 10/1960 | (FR) . |

* cited by examiner

*Primary Examiner*—Kevin Shaver
*Assistant Examiner*—David A Bonderer
(74) *Attorney, Agent, or Firm*—Edward A. Squillante, Jr.

(57) ABSTRACT

A container (1) for storing and dispensing fluid material, in particular liquid detergents or the like, comprises a flexible collapsible storage portion (4) for storing the fluid material, and a dispensing portion (5) in communication with the storage portion in order to dispense the fluid material from the storage portion in a controlled manner. The storage portion has a substantially rectangular rounded shape. One side (7) thereof contains the dispensing portion. The dispensing portion (5) is pivotally connected to the edge (6) of said one side (7) of the storage portion (4), which slopes away inwardly from the dispensing portion in order to accommodate the folded-in dispensing portion.

The invention also includes a combination package which comprises said container (1) and an outer cover (2, 2'). The outer cover has a rectangular shape and includes walls (14, 15) fitting around the filled container and having a portion allowing the passage of the dispensing portion when in use. The folded-in dispensing portion is accommodated between said one side (7) of the container (1) and the adjacent wall (14) of the cover (2, 2').

8 Claims, 4 Drawing Sheets

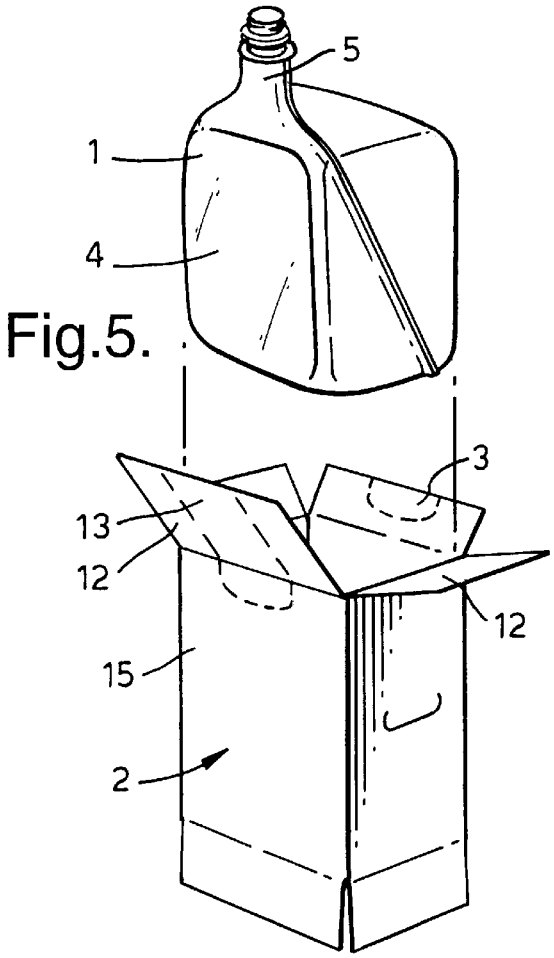
Fig.5.
Fig.6.
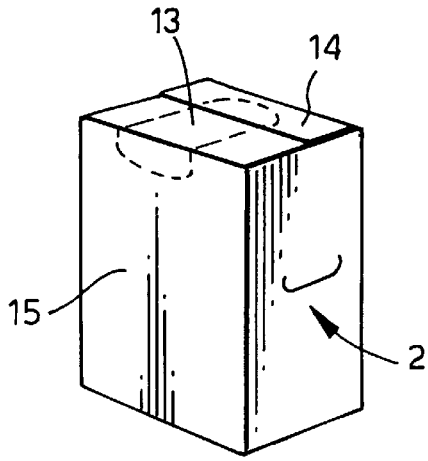
Fig.8.
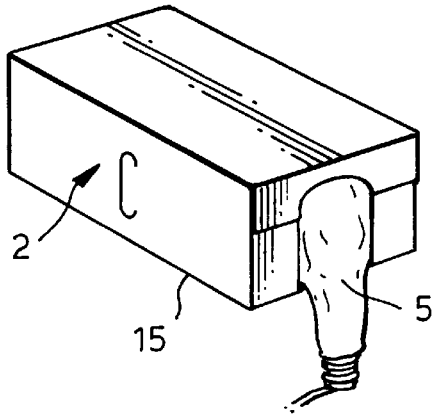
Fig.7.
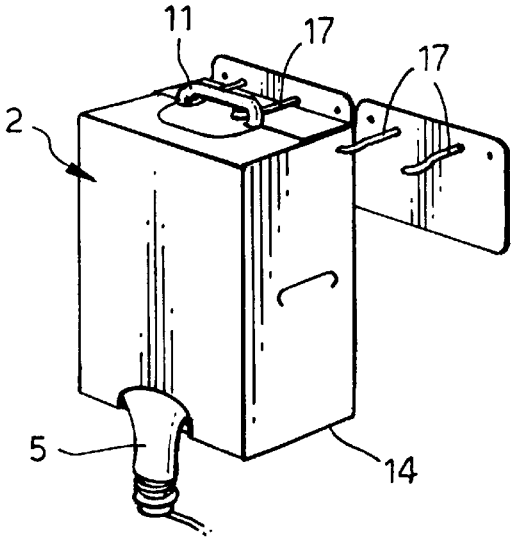

CONTAINER AND COMBINATION PACKAGE COMPRISING SUCH CONTAINER AND A COVER

FIELD OF THE INVENTION

The invention relates to a container for storing and dispensing fluid material, in particular liquid detergents or the like, comprising a flexible collapsible storage portion for storing the fluid material, and a dispensing portion in communication with the storage portion in order to dispense the fluid material from the storage portion in a controlled manner, the storage portion having a substantially rectangular rounded shape, one side thereof containing the dispensing portion; as well as to a combination package comprising such container and an outer cover having a rectangular shape and including walls fitting around the filled container and having a portion allowing the passage of the dispensing portion when in use.

BACKGROUND OF THE INVENTION

Flexible packaging is often used as an alternative for rigid canisters due to the benefits of low waste, volume and weight. In most cases the flexible inner container is packed in a rigid outer cover. The flexible container acts as a liner and contains the fluid material, the cover, often made of cardboard, allowing the combination package to be stacked and protects the vulnerable container against damage.

The size and weight of the package, with a volume in the range of 1 up to 30 liter, generally do not allow manipulation of the package, therefore they are often used as a stationary "bulk" reservoir, placed on a rack, shelf or stand, with a device connected to the dispensing portion to allow the fluid material being poured or pumped out in a controlled manner.

In the prior art there are two types of combination packages: ready for use packs and closed packs. The ready for use packs have a neck or pouring opening which is accessible and which is fixed on the outer surface of the cover. These packages are ready for use, no additional handling other than removing the tamper evident closure of the pouring opening is required. The neck, cap or closure is in this case prefixed in the cardboard cover. To avoid the risk of damage during transport and enable stacking, these packages either have to be transported in an additional cardboard cover, or require an additional top, like the Safebox pack™, to fill up the empty space between the rigid neck/closure and the cardboard cover in order to create a cubical form. In both cases the space utilization is poor because "dead volume" is created in the additional transport cover. Although the convenience aspect of the ready for use packages can be seen as a benefit, the cost and complexity of production and, after use, separation of the plastic cover from the cardboard cover is a clear disadvantage.

The closed packages have as their dispensing portion a "hidden" neck and closure. These packages show a better space utilization than the ready for use packages as a minimum of empty top space is required. In order to initiate the use of these packages, the cardboard cover needs to be opened first and then the dispensing portion needs to be positioned and fixed in the cardboard cover. Therefore, these closed packs are less convenient for the user.

Apart from the details of the fixation of the dispensing portions, both types of packages have the problem of residue of the fluid material left behind after use when the package is placed horizontally.

The object of the present invention is to provide a container and a combination package including a container and a cover in which these problems are solved in an effective way.

It was surprisingly found that this object could be achieved with the container and combination package of the present invention.

SUMMARY OF THE INVENTION

Accordingly, the present invention provides a container and a combination package which are characterized in that the dispensing portion is pivotally connected to the edge of said one side of the storage portion, which slopes away inwardly from the dispensing portion in order to accommodate the folded-in dispensing portion and/or in that the dispensing portion is pivotally connected to the edge of said one side of the storage portion, and the dispensing portion forming an extension of the side adjacent said edge.

Due to the placement of the dispensing portion with respect to the storage portion of the container, it is possible to fold-in the dispensing portion close to the side of the storage portion of the container so that the cover can have a volume which is only slightly larger than that of the container. The construction of the dispensing portion as an extension of an adjacent side of the container allows the use of the container in two positions, i.e. with said one side directed downwardly or with the adjacent side directed downwardly, without a residue being left behind. This is the result of the lack of a rim between the bottom of the container and the lower side of the dispensing portion. In a further development of the combination package there is created an opening means in the cover allowing the passage of the dispensing portion when in use, which is characterized in that the opening means is a tear-away part of the outer cover which is positioned and dimensioned such that removal of the tear-away part is sufficient to enfold the dispensing portion to the dispensing position.

This feature makes the package ready for use: only the tear-away portion needs to be removed or folded open to be able to use the container, no pre-fixation of the dispensing portion is required. As no end user action is required to prepare the opening of the package, a more reliable usage of the dispensing portion can be guaranteed.

BRIEF DESCRIPTION OF THE DRAWINGS

The invention will hereafter be elucidated with reference to the drawings schematically showing embodiments of the invention by way of example.

FIG. 5 is a perspective view of the combination package of FIG. 4 with the cover thereof opened and the container removed therefrom.

FIGS. 6, 7 and 8 are perspective views of the combination package in the storage condition and in two different dispensing positions.

DETAILED DESCRIPTION OF THE INVENTION

The drawings show an embodiment of a flexible plastic container 1 which is used as a packaging for fluid material, such as for example liquid detergent or other liquid or flowable materials. The container 1 can be used alone but in most cases it will be combined with a cover 2, mostly but not exclusively made out of cardboard in order to provide a rigid outer for the container at least during transport and storage, but frequently also when the container is in use for dispensing the contents.

Figure 1:
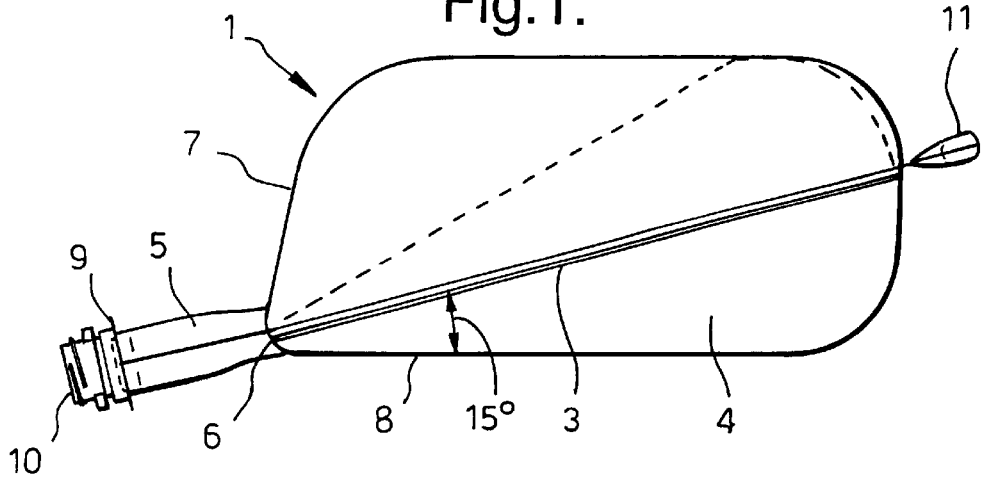
FIG. 1 is a side view of the embodiment of the container according to the invention.
Figure 2:
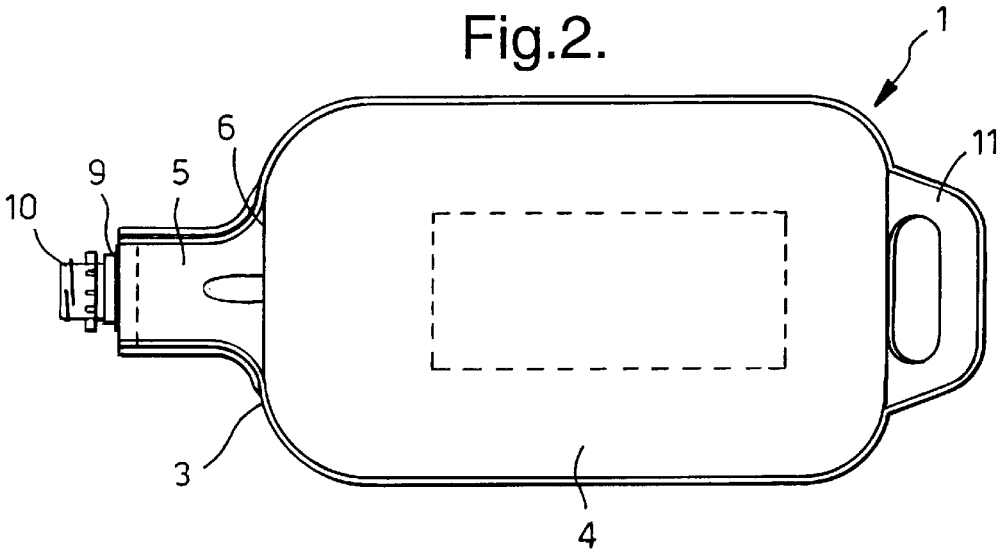
FIG. 2 is a top view of the container of FIG. 1.
Figure 3:
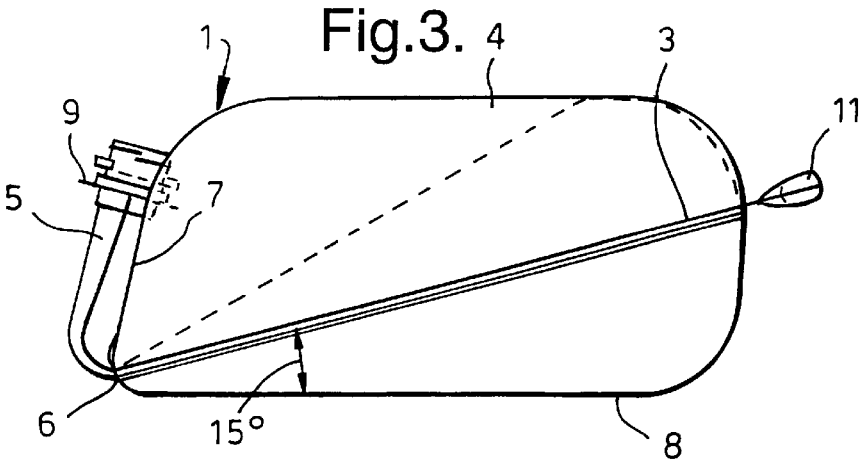
FIG. 3 is a view corresponding to that of FIG. 1, with the dispensing portion being folded into the storage position.

FIGS. 1, 2 and 3 show the construction of the container 1. In general it has a substantially rectangular, although rounded shape in order to be accommodated in the rectangular cover 2.

The container 1 is made of two parts welded together through a seam 3 which runs more or less diagonally around the container 1. The seam 3 runs both around a storage portion 4 of the container and alongside a dispensing portion 5 which is in communication with the storage portion 4 in order to dispense the fluid material from the storage portion in a controlled manner.

The dispensing portion 5 is positioned on an edge 6 on one small side 7 of the container and the dispensing portion 5 is constructed as an extension of the large bottom side 8 of the container 1 which is on the other side of the edge 6 in relation to side 7.

The dispensing portion 5 is funnel-shaped and is flexible at least in a portion adjacent the storage portion 4 in order to be able to pivot with respect to the storage portion 4. This pivotability of the dispensing portion 5 allows it to be folded-in to a storage position in which it abuts the side 7 of the storage portion 4 along its full length, as is shown in FIG. 3 of the drawing. FIGS. 1 and 3 further show that said side 7 slopes inwardly away from the edge 6 where the dispensing portion 5 is positioned, so that room is created to accommodate a rigid neck 9 at the free end of the dispensing portion 5. This allows a very efficient space utilisation of the container 1 in the cover 2 with only a very small dead volume. The angle of the slope of side 7 may for example be 10–20°.

The length of the dispensing portion 5, when folded, is between ca. 75 and 100% of the length of the side 7, or the height of the container 1. In this way, the rigid neck 9 of the dispensing portion 5 is positioned near the edge of said one side 7 opposite the edge 6 where most room is available for accommodating the rigid neck 9.

Before use, the rigid neck 9 of the dispensing portion 5 will be closed by a tamper evident cap 10 and when the cap 10 is removed, the neck 9 has a female portion to which a male valve or pouring mechanism can be connected in order to be able to dispense the contents from the container 1 in a controlled manner. In the female part of the rigid neck 9 of the dispensing portion 5 there may be arranged an angular ring of absorbent sponge like plastic material preventing the risk of any residue liquid in the dispensing portion 5 from dripping off after separation of the male part.

FIGS. 1–3 further show that the side of the storage portion 4 opposite the dispensing portion 5 is optionally equipped with a carrying handle 11. The position of the handle 11 is such that the seam 3 extends around the handle 11. Thus, as can be seen in FIG. 1, the handle 11, the seam 3 and the dispensing portion 5 are aligned with each other, and the seam 3 splits the storage portion 4, the dispensing portion 5 and the handle 11. The handle 10 can be used for carrying the container 1 and/or 4 for suspending the container 1 from hooks or the like in order to use the container 1 in a verticle position (see FIGS. 7, 12).

Figure 4:
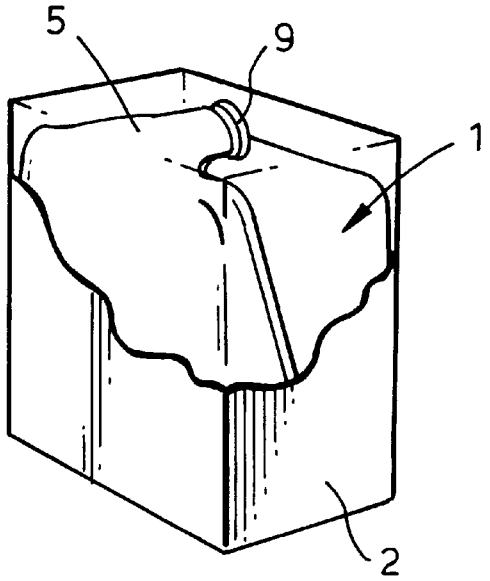
FIG. 4 is a partially cut away perspective view of a combination package in the storage condition.

FIG. 4 shows the container 1 in the closed cover 2. In this position, the combination package will leave the factory and it will remain in this condition until the user will start using the package in order to dispense the contents of the container 1.

FIG. 5 shows that the cover 2 is made of a piano which is folded and flaps of it are fixed to each other in order to form a box-like carton. The container 1 can be loaded from above into the preassembled cover 2 and after insertion of the container 1 into the cover 2, the flaps 12 forming one side of the cover 2 will be folded and connected in order to close the cover 2. It is also shown in FIG. 5 that two opposite flaps 12 contain a tear-away part 13 which is connected to the surrounding part of the cover 2 through tear lines and which may be pulled away from said side wall 14 of the cover 2 in order to form an opening through which the dispensing portion 5 is accessible and through which the dispensing portion 5 may pass in order to move the dispensing portion 5 from the storage position to the dispensing position. The tear-away part 13 extends across the sidewall 14 of the cover 2 to such an extent that the dispensing portion 5 may easily be pulled out of the cover 2 through the opening. The tear-away part 13 also extends on a side wall 15 adjacent the side wall 14 (see FIG. 6) and this allows the use of the combination package in both the vertical position according to FIG. 7 and the horizontal position according to FIG. 8. Due to the shape and position of the dispensing portion 5 there is no risk of a residue left behind in the storage portion 4 of the container 1 since in both positions the lower side of the dispensing portion 5 connects to the adjacent side of the storage portion 4 without any rim or other threshold preventing the last portion of the fluid material from flowing into the dispensing portion 5.

FIG. 7 shows the handle 11 of the container 1 projecting through an opening 16 in the cover 2 in order to enable the combination package to be carried and to be hooked onto hooks 17. In this dispensing position the sidewall 14 of the cover 2 is directed downwardly. This dispensing position is characterized as vertical position since the long axis of the combination package is positioned vertically.

Figure 9:
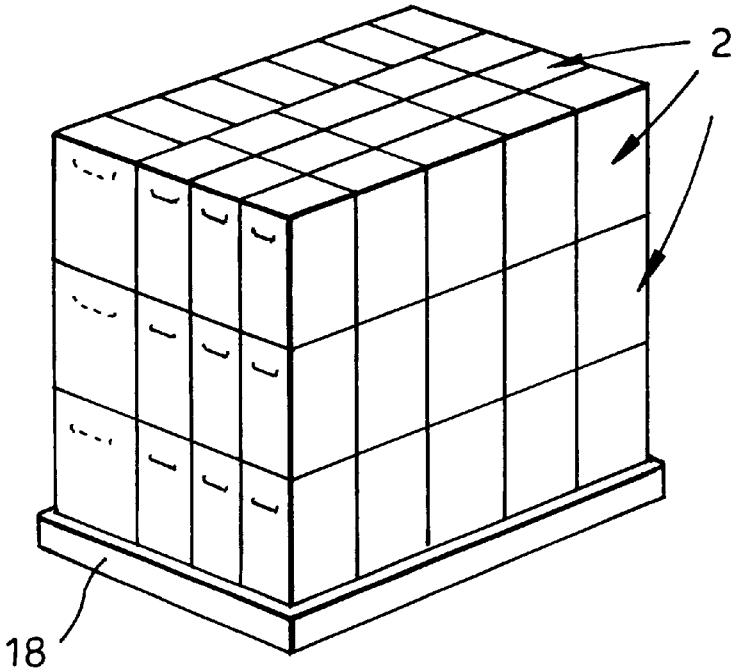
FIG. 9 is a perspective view, on a smaller scale, of a plurality of combination packages stacked on a pallet.
Figure 10:
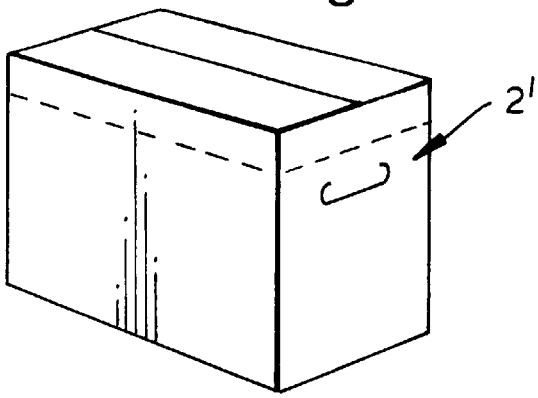
FIGS. 10, 11 and 12 are perspective views of a second embodiment of the combination package, wherein two containers are housed in one cover and are used in their dispensing position within a separate dispenser housing.
Figure 11:
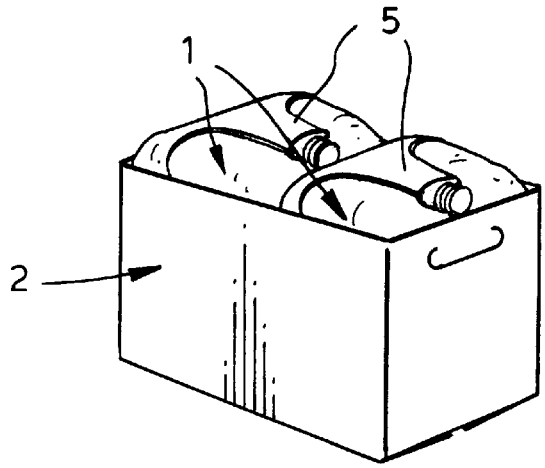
Figure 12:
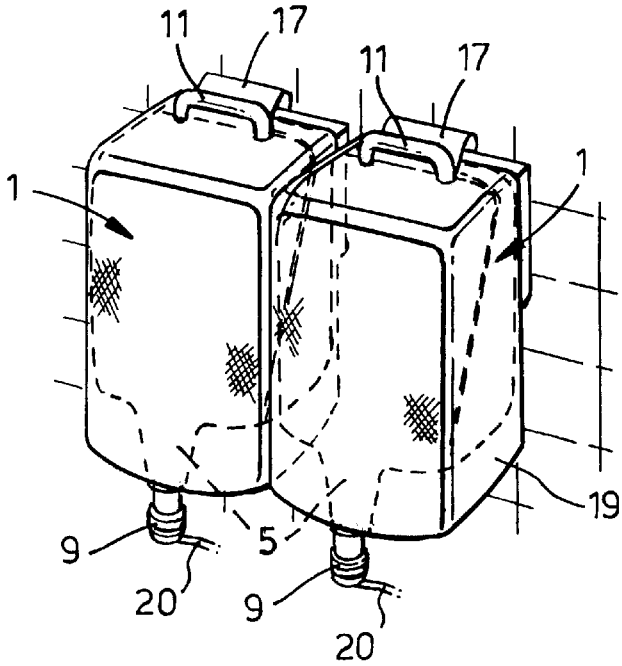

In FIG. 8, the combination package is shown in its horizontal dispensing position with sidewall 15 directed downwardly and the long axis extending horizontally. In FIG. 9 there is shown a pallet 18 with a great number of combination packages stacked, which is enabled by the use of the rigid covers 2 tightly surrounding the containers 1. FIGS. 10–12 show a second embodiment of the combination package, wherein two containers 1 are accommodated together in a large cover 2'. In this embodiment, the cover 2' is only used for storing and transporting the containers 1. When the containers 1 are to be used, a top part of the cover 2' can be removed and the containers 1 can be taken out in order to be hooked onto a hook 17 which may be used alone or which may form part of a dispenser housing 19 in which a container 1 is accommodated in vertical position. FIG. 12 shows a valve 20 connected to the neck 9 of each container 1 in order to control the flow of material from the containers.

From the foregoing it will be clear that the invention provides a container and combination package which combine the compactness of the prior art closed packs with the convenience of the ready for use packs.

The invention is not restricted to the embodiment shown in the drawings and described hereinbefore which may be varied in different manners within the scope of the invention.

What is claimed is:

1. Container (1) for storing and dispensing fluid material, comprising a flexible collapsible storage portion (4) for storing the fluid material, and a dispensing portion (5) in communication with the storage portion in order to dispense the fluid material from the storage portion in a controlled manner, the storage portion having a substantially rectangular rounded shape, one side (7) thereof containing the dispensing portion, wherein the dispensing portion (5) is pivotally connected to the edge (6) of said one side (7) of the storage portion (4), which slopes away inwardly from the dispensing portion in order to accommodate the dispensing portion, and wherein a neck 9 of the dispensing portion (5) is provided with a female connecting piece to connect with a male member incorporating a valve, and an annular ring, of absorbent material being fitted into the female connecting piece to absorb fluid when the male member is disconnected.

2. Container according to claim 1, wherein the dispensing portion (5) forms an extension of a side (8) of the storage portion (5) adjacent said edge (6) of said one side (7).

3. Container according to claim 1, wherein the dispensing portion (5) is funnel-shaped and has a rigid cylindrical neck (9) and closure (10), and is connectable to a part comprising a valve.

4. Container according to claim 1, wherein the dispensing portion (5) has a length from said edge which is about 75 to 100% of the length of said one side (7) from said edge (6), or 75 to 100% of the depth of the container in said direction, respectively.

5. Container according to claim 1, wherein the container (1) is formed from two parts which are connected through a seam (3) running substantially diagonally of the storage portion (4) and through the central plane of the dispensing portion (5).

6. Container according to claim 5, wherein a carrying handle (11) is provided on the side of the container (1) opposite the side (7) containing the dispensing portion (5), the seam (3) also running through the central plane of the handle.

7. Combination package for storing and dispensing fluid material, in particular liquid detergents, comprising an inner container (1) and an outer cover (2), wherein the container comprises a flexible collapsible storage portion (4) for storing the fluid material and a foldable dispensing portion (5) in communication with the storage portion in order to dispense the fluid material from the storage portion in a controlled manner, the storage portion having a substantially rectangular rounded shape, one side (7) thereof containing the dispensing portion, whereas the outer cover having a rectangular shape including walls fitting around the filled container and having opening means (13) allowing the passage of the dispensing portion when in use, in its place the opening means (13) is a tear-away part of the outer cover (2) which is positioned and dimensioned such that removal of the tear-away part is sufficient to unfold the dispensing portion (5) to the dispensing position.

8. Combination package according to claim 7, wherein the dispensing portion (5) is pivotally connected to the edge (6) of said one side (7) of the storage portion (4), and the dispensing porting forming an extension of the side (8) adjacent said edge (6), whereas the opening means (13) extend partially over said one side (7) and said adjacent side (8) to enable the use of the combination package both with the one side (7) and with the adjacent side (8) directed downwardly.

* * * * *